US007509769B2

(12) United States Patent
Wilcox et al.

(10) Patent No.: US 7,509,769 B2
(45) **Date of Patent: *Mar. 31, 2009**

(54) ADJUSTABLE OUTRIGGER HOLDER FOR THE TOP OF A BOAT

(76) Inventors: Roger Wilcox, 609 5th Key Dr., Fort Lauderdale, FL (US) 33303; Scott Wilcox, 9721 N. New River Canal Rd., #312, Plantation, FL (US) 33324

( * ) Notice: Subject to any disclaimer, the term of this patent is extended or adjusted under 35 U.S.C. 154(b) by 169 days.

This patent is subject to a terminal disclaimer.

(21) Appl. No.: 11/709,408

(22) Filed: Feb. 22, 2007

(65) Prior Publication Data

US 2007/0157863 A1 Jul. 12, 2007

(51) Int. Cl.
*A01K 97/10* (2006.01)
*B63B 35/14* (2006.01)

(52) U.S. Cl. ..... 43/21.2; 114/255; 248/514

(58) Field of Classification Search ..... 114/255, 114/343, 364; 248/514–516; 43/18.1 R, 43/19.2, 21.2, 27.2, 27.4
See application file for complete search history.

(56) References Cited

U.S. PATENT DOCUMENTS

| | | | | |
|---|---|---|---|---|
| 4,803,938 | A * | 2/1989 | Sergeant | 114/39.3 |
| 4,993,346 | A * | 2/1991 | Rupp | 114/255 |
| 5,592,893 | A * | 1/1997 | Jordan et al. | 114/255 |
| 5,738,035 | A * | 4/1998 | Rupp, II | 114/255 |
| 5,778,817 | A * | 7/1998 | Rupp | 114/255 |
| 6,668,745 | B2 * | 12/2003 | Slatter | 114/255 |
| 6,766,757 | B1 * | 7/2004 | Tilley | 114/255 |
| 7,197,845 | B2 * | 4/2007 | Wilcox et al. | 43/21.2 |

* cited by examiner

*Primary Examiner*—Ajay Vasudeva
(74) *Attorney, Agent, or Firm*—Frank J. Benasutti

(57) ABSTRACT

A holder for an outrigger is disclosed which has a housing for mounting the holder on top of a structural part of a boat. The holder can be rotated in a horizontal plane to various fixed positions by means of a rotatable, retractable handle positioned below the structural part of the boat. The weight of the holder is taken by in internal structure of the housing, such that, during rotation to another position, the holder weight is not transferred to the handle; thereby making it easier to rotate the holder.

7 Claims, 5 Drawing Sheets

ADJUSTABLE OUTRIGGER HOLDER FOR THE TOP OF A BOAT

CROSS REFERENCE TO RELATED APPLICATIONS

This application claims the benefit of the filing date of our prior application Ser. No. 10/801,275 filed Mar. 16, 2004, now U.S. Pat. No. 7,197,845, and the provisional application No. 60/455,982, filed Mar. 19, 2003 referenced therein, the disclosures of which are incorporated herein by reference as if fully set forth.

BACKGROUND OF THE INVENTION

1. Technical Field

This invention relates to fishing equipment and, more particularly, to an outrigger holder apparatus for mounting on a structural portion of a boat, such as, the top of a boat.

2. Description of the Prior Art

In the prior art of sport fishing equipment, it is known to use outriggers to play out trolling lines away from the sides and back of the boat. These outriggers can be moved in line with the hull and in-board of the boat when they are not being used for trolling. Thus, they are adjustable between the trolling position and the storage position.

These outriggers can be mounted on bases which are either fixed to the gunnels or tops of the boats. They can be adjustable, in that the outrigger can be swung outwardly to a plurality of fixed positions.

Prior art outriggers are shown in U.S. Pat. Nos. 2,927,754, 3,008,259, 3,161,390, 3,190,594, 3,724,791, 5,445,102, and 5,592,893. These patents also show the holders for the outriggers. Many of these patents disclose two means of adjustment: one means of rotating the outrigger holder to move it in a horizontal plane and another means of angling the outrigger holder in a vertical plane.

On a boat which has a T-top, it is desirable to have an outrigger mounted on top of the T-top, while having its control mechanism mounted below the T-top. Outriggers specifically designed for T-top boats are shown in U.S. Pat. Nos. 4,993,346, 5,738,035 and 5,778,817. One of the problems presented by these devices is the awkwardness and strength needed in operating them. For example, in the '346 patent, when the fisherman using the device wishes to rotate the outrigger, he will grab the lever 170 in one hand and push upwardly with his other hand on the extension of the lever member. This is done to retract the plunger from the bore, enabling the tubular element in turn to move the outrigger into another position. The weight of the outrigger must be borne throughout this procedure; making it extremely difficult.

In addition, the "T" Top construction of the boat is generally made of a light weight, somewhat flimsy tubing. Thus it is desirable to provide a strengthening support to tie in the tubing and provide a more rigid support for the outrigger holder.

SUMMARY OF INVENTION

We have invented an outrigger holder which is easy to manipulate to move the outrigger held thereby from inboard to outboard positions and back; all from under the structural part of the boat upon which the outrigger holder is mounted. This ease of movement is provided by a new bearing structure which absorbs the weight of the outrigger holder portion during indexing.

DESCRIPTION OF THE PREFERRED EMBODIMENTS

Figure 1:
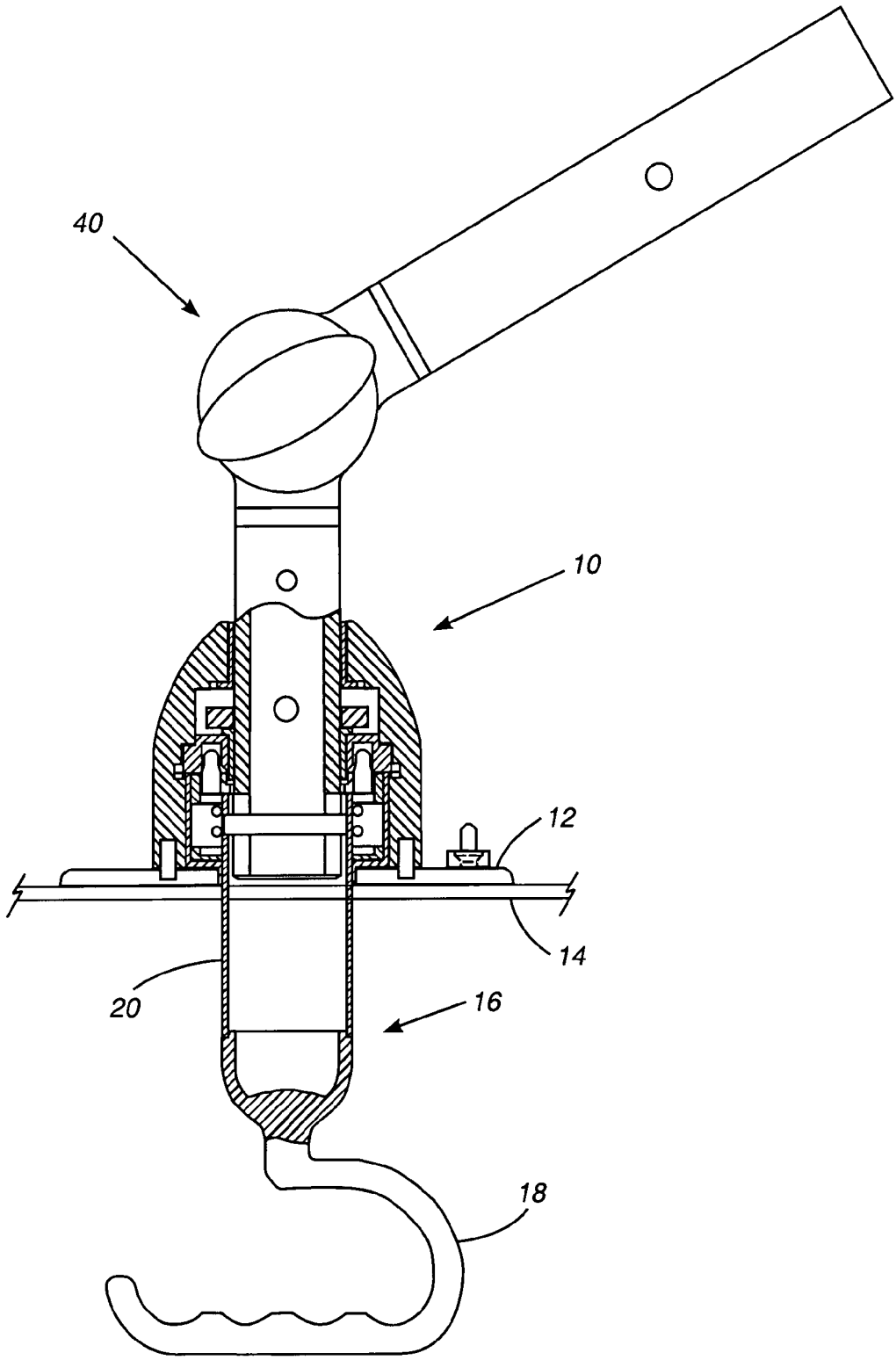
FIG. 1 is an exploded side elevation, partially broken away and shown in section, of an adjustable outrigger holder apparatus in accordance with our invention.

Referring to the Figures, FIG. 1 shows a perspective view of an apparatus in accordance with our invention which comprises an outrigger holder portion designated generally 10 secured to a mounting plate 12 mounted on top of a structural portion 14 of a boat. A retractable, rotatable key portion designated generally 16 is positioned below the structural portion 14 of the boat.

A retractable, rotatable key portion 16 comprises a handle means 18, a driver tube 20 attached thereto, a pin base 22 affixed to the other end of the driver tube 20 and a plurality of pins 24 fixed to and extending upwardly from the pin base 22. Each pin 24 is frustro-conical to allow for insertion into mating holes in the upper portion as will be more fully described herein after.

Figure 2:
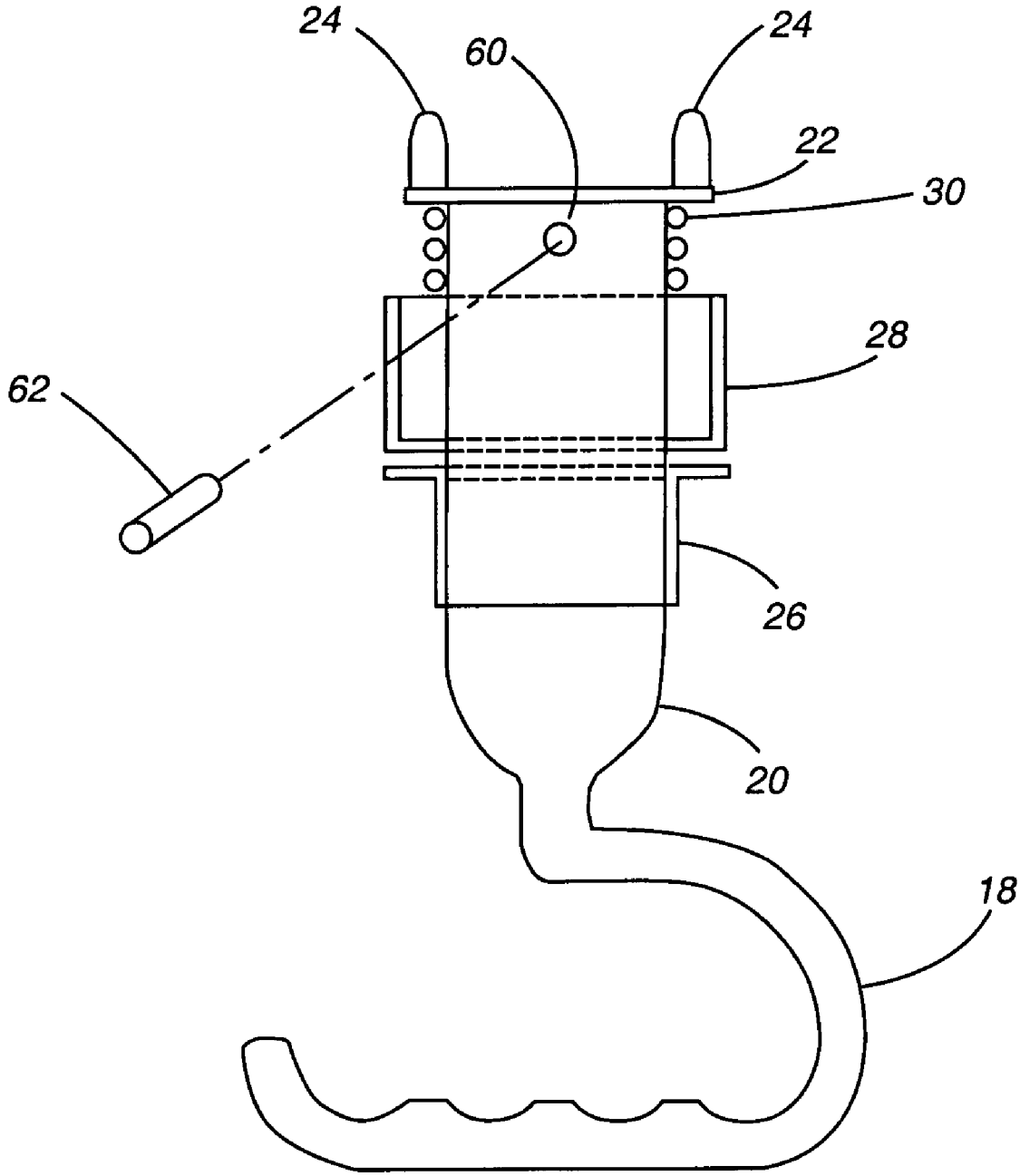
FIG. 2 is a side elevation, partially in section of a portion of the apparatus shown in FIG. 1.

As can be seen more clearly in FIG. 2, a bearing bushing 26 is positioned about the drive tube 20 to provide a bearing surface between the mounting plate 12. The bushing has an outwardly extending flange to rest it on the upper surface of the mounting plate.

Resting upon the bushing 26 is a spring cup 28. Positioned about the drive tube 20 and within the confines of the upwardly extending cylindrical wall of the cup is a spring 30.

When the apparatus is in a fixed position, the spring 30 is collapsed and exerts a force against the bottom of the spring cup and the undersurface of the annular pin base 22, thus driving the pin base into engagement with a mating part in the outrigger holder portion 10.

Figure 3:
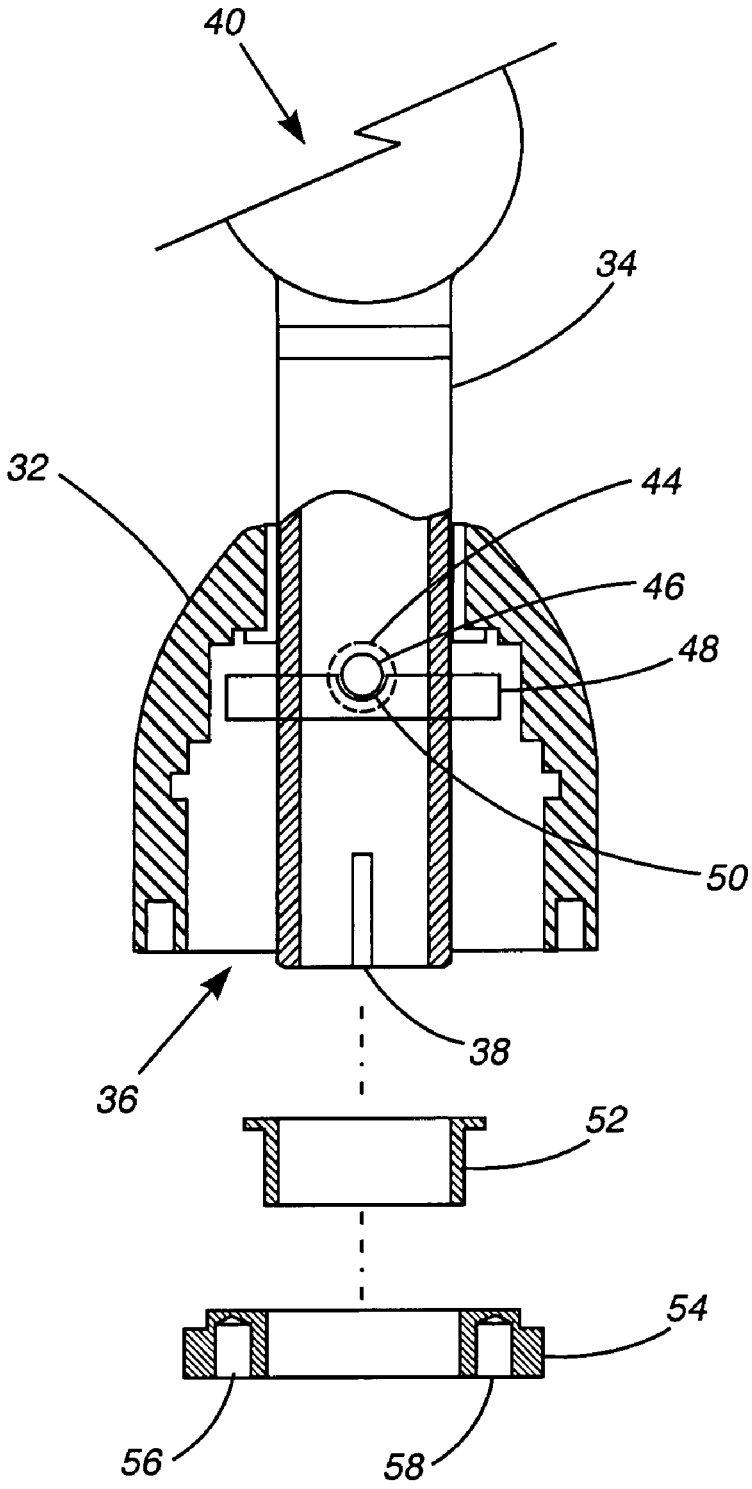
FIG. 3 is an exploded side elevation partially in section of a portion of an apparatus as shown in FIG. 1.

The outrigger holder portion 10 comprises a housing 32 FIG. 3.

Extending through this part is a driven tube 34 terminating in a forked end portion designated 36 which provides an open slot 38 at the end of the tube 34.

The upper end of the driven tube 34 terminates in a mating portion of the outrigger holder vertical adjustment assembly, designated generally 40.

A bearing bushing 42 is positioned about the driven tube 34 to provide a bearing surface between the driven tube 34 and the housing 32. The bushing 42 has an outwardly extending flange to rest it on the under surface of a relieved portion of the mounting housing 32.

There is a hole 44 on a diameter through the cylindrical wall of the driven tube 34. Mounted through and extending from this hole is a support pin 46.

Embracing the driven tube 34 is a segment seat 48 with a half-circular detent 50 formed on a diameter in the seat 48 and dimensioned to embrace the support pin 46.

A bearing bushing 52 is positioned about the driven tube 34 to provide a bearing surface between the driven tube and the flower 54. The bushing 52 has an outwardly extending flange to rest it on the upper surface of the flower 54.

The inside housing 32 is configured with inwardly extending ribs 56. The flower 54 has a peripheral configuration to mate with the ribbed configuration of the housing 32. Thus the flower 54 is keyed into the inner walls of the housing 32, by its complementary configured outer periphery; which prevents it from being rotated in the assembled condition. A "C" spring clip 55 is retained in a groove 57 in the ribs 56 of the housing 32. When the flower 54 is positioned within the housing 32, the spring clip 55 is compressed slightly and inserted into the grooves and released, to thereby retain the flower in the housing.

The flower 54 has holes 56 therein on its lower surface. These holes are positioned to mate with the pins 24 of the drive tube 20, in the fixed condition of the apparatus as shown in FIG. 1.

There is a diametrically extending hole 60 FIG. 2 through the cylindrical wall of the drive tube 20. Fixedly mounted through this hole in the wall of the tube 20 is a drive pin 62. The drive pin 62 is positioned and dimensioned to fit within the slot 38 of the driven tube The housing 32 is fixedly mounted to the mounting plate 12. With the apparatus in the fixed position as shown in FIG. 1, the pins 24 are in engagement with the holes 56 in the flower 54 and thus prevent the drive tube 20 from rotating. This is its normal, at rest condition.

Figure 4:
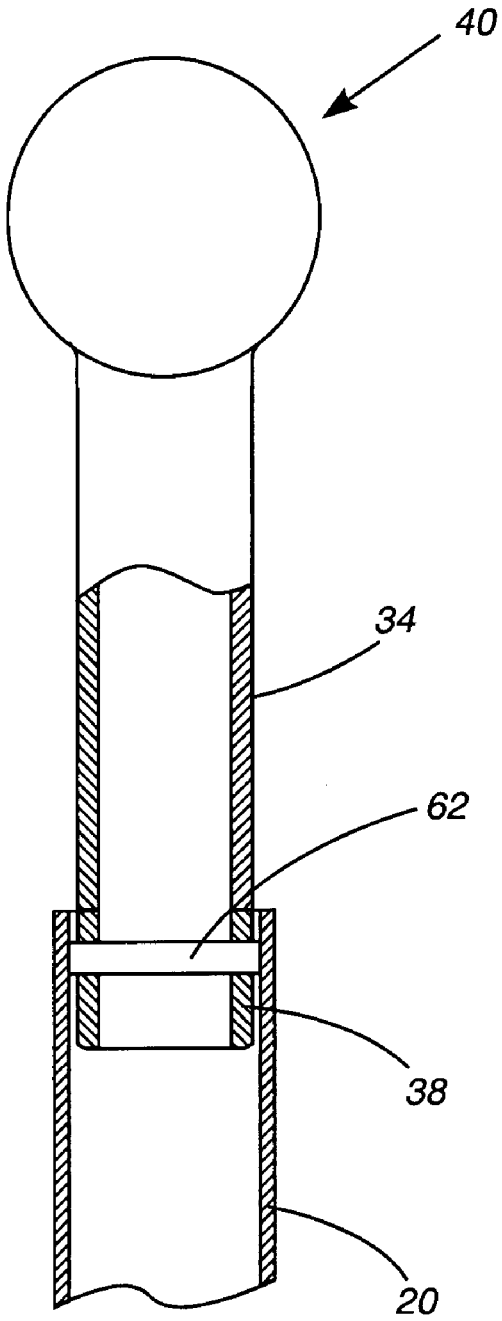
FIG. 4 is an exploded side elevation partially in section of a portion of an apparatus as shown in FIG. 1.
Figure 5:
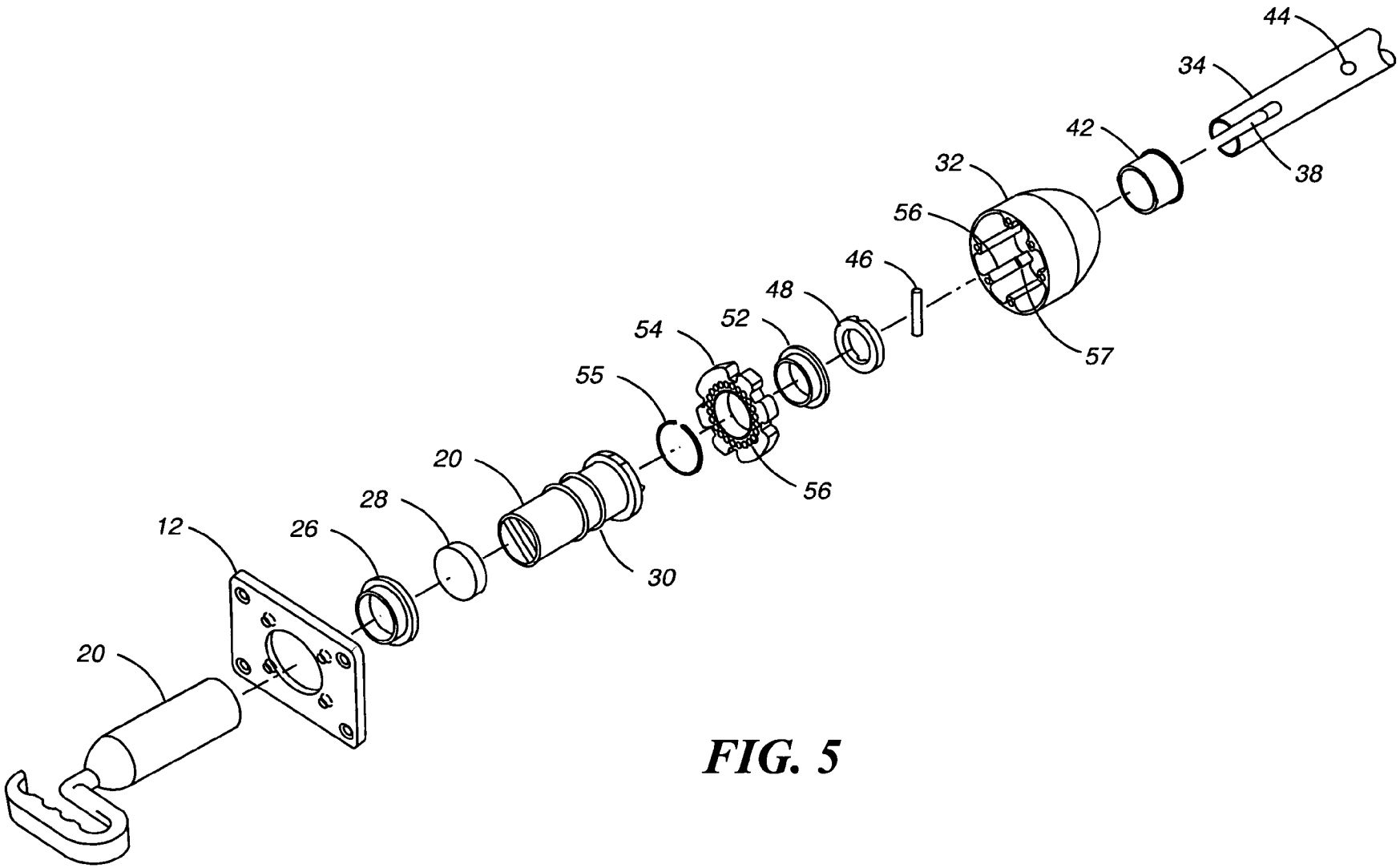
FIG. 5 is an exploded view of the apparatus.

To rotate the driven tube 34 and thus reposition the outrigger holder in a horizontal plane, the handle 18 is first pulled down until the pins 24 are disengaged from the flower 54. The handle and drive tube 20 can now be rotated. Upon rotation, the drive pin 62 engages the driven tube 34 and rotates it See FIG. 4. During this rotation, the weight of the outrigger holder and outrigger, is absorbed by the bearing surfaces provided by the lower surface of the segment seat 48 and the upper surface of the bearing bushing 52. Any downward force is expended against the resistance provided by the fixed structure of the flower 54 retained in the housing 32. Thus the force is absorbed above the structure of the boat upon which the outrigger holder is mounted.

When one stops exerting a downward force on the handle 18, the force of the spring 30 takes over and moves the key portion upwardly to a position for re-engagement of the pins 24 within the holes 56 of the flower 54.

Thus we have provided an indexing means whereby an outrigger holder can be rotated horizontally to move an outrigger inboard or outboard to a plurality of fixed positions, without contending with the weight of the outrigger. Our invention comprises, a mounting means for mounting an outrigger holder on a structural part of a boat; said mounting means further comprising a housing means for fixedly mounting the outrigger holder apparatus on said structural part; an outrigger holder means mounted in said housing means for rotation therein; a bearing means engaging said outrigger holder and said housing means for providing a bearing there between positioned above the structural part to bear the weight of the outrigger holder above the structural part upon rotation of the outrigger holder; said mounting means for the outrigger holder further comprising an indexing means for adjusting the position of the outrigger holder means to a plurality of fixed positions in a horizontal plane from underneath the structural part upon which the outrigger holder means is mounted; said indexing means having a first portion engaging said housing means and a second portion for selectively engaging and disengaging with said first portion; said second portion when disengaged from said first portion being positioned to engage and rotate said outrigger holder means without bearing the weight of the outrigger holder means.

The outrigger holder apparatus further comprising a release and turning mechanism engaging said mounting means for the outrigger holder means for moving the outrigger holder to and holding the outrigger holder in, a plurality of fixed horizontal positions.

We have invented an outrigger holder apparatus wherein the release and turning mechanism further comprises a lock engaging said outrigger holder and said mounting means; and a key being movable to disengage from said lock said and mounting means and thereby allow said key to be rotated in a horizontal plane to rotate the outrigger holder to a different fixed position.

We have invented an outrigger holder apparatus wherein said lock comprises a flower engaging said housing; said flower having a plurality of holes therein; said key having a plurality of pins extending therefrom being positioned for insertion into and retraction from said holes in said flower.

We have further invented an outrigger holder apparatus wherein said lock comprises a flower engaging said housing; and said apparatus further comprises a bearing mounted in and extending above said flower; and a segmented seat positioned above said bearing to rest upon said bearing; said outrigger holder having a tube portion extending through said housing and a pin extending through the wall of said tube; said seat having a detent therein and said pin being disposed in said detent to bear upon said seat.

We have further invented an outrigger holder apparatus wherein said key further comprises a tube portion and a pin extending through the wall of said tube portion; and said outrigger holder further comprising a tube portion with a slot therein; said tube portions being juxtaposed such that the pin in the tube portion of the key is in the slot of the tube portion of the outrigger holder.

We have further invented an outrigger holder apparatus wherein said lock comprises a flower in the housing means having a plurality of holes therein; said key further comprising a tube portion with a pin base at one having a plurality of pins extending therefrom being positioned for insertion into and retraction from said holes in said flower; said tube portion having a handle at an end opposite from the end with the pin base; a bushing mounted about said tube portion for insertion through the structural part of the boat to provide a bearing between the tube portion and the structural part; said bearing having a lip extending therefrom above the structural part; a spring cup embracing said tube portion above said bushing and said lip and resting upon said lip and containing a spring which is positioned about said tube portion; said spring engaging said pin base; whereby when said handle is pulled in an axial direction with respect to said tube portion, the pin base compresses said spring as the pins in the base are disengaged from said lock.

We have used the term "flower" for the part numbered 54. However, it will be understood by those in the art that this part may have other shapes, so long as it can be fixedly mounted in the housing and perform the same functions of support and locking as this part.

What is claimed is:

1. An outrigger holder apparatus for a boat comprising: a mounting means for mounting an outrigger holder on a structural part of a boat; said mounting means further comprising a housing means for fixedly mounting the outrigger holder apparatus on said structural part;

said outrigger holder mounted in said housing means for rotation therein;

a bearing means engaging said outrigger holder and said housing means for providing a bearing therebetween positioned above the structural part to bear the weight of the outrigger holder above the structural part upon rotation of the outrigger holder;

said mounting means for the outrigger holder further comprising an indexing means for adjusting the position of the outrigger holder to a plurality of fixed positions in a horizontal plane from underneath the structural part upon which the outrigger holder is mounted;

said indexing means having a first portion engaging said housing means and a second portion for selectively engaging and disengaging with said first portion; said second portion when disengaged from said first portion being positioned to movably engage and rotate said outrigger holder without bearing the weight of the outrigger holder.

2. The outrigger holder apparatus of claim 1 further comprising a release and turning mechanism engaging said mounting means for the outrigger holder for moving the outrigger holder to and holding the outrigger holder in, a plurality of fixed horizontal positions.

3. The outrigger holder apparatus of claim 2 wherein the release and turning mechanism further comprises a lock engaging said outrigger holder and said mounting means; and a key being movable to disengage from said lock and said mounting means and thereby allow said key to be rotated in a horizontal plane to rotate the outrigger holder to a different fixed position.

4. The outrigger holder apparatus of claim 3 wherein said lock comprises a flower engaging said housing; said flower having a plurality of holes therein; said key having a plurality of pins extending therefrom being positioned for insertion into and retraction from said holes in said flower.

5. The outrigger holder apparatus of claim 3 wherein said lock comprises a flower engaging said housing; and said apparatus further comprises a bearing mounted in and extending above said flower; and a segmented seat positioned above said bearing to rest upon said bearing; said outrigger holder having a tube portion extending through said housing and a pin extending through the wall of said tube; said seat having a detent therein and said pin being disposed in said detent to bear upon said seat.

6. The outrigger holder apparatus of claim 3 wherein said key further comprises a tube portion and a drive pin extending through the wall of said tube portion; and said outrigger holder further comprising a tube portion with a slot therein; said tube portions being juxtaposed such that the drive pin in the tube portion of the key is in the slot of the tube portion of the outrigger holder.

7. The outrigger holder apparatus of claim 3 wherein said lock comprises a flower in the housing means having a plurality of holes therein; said key further comprising a tube portion with a pin base at one end having a plurality of pins extending therefrom being positioned for insertion into and retraction from said holes in said flower; said tube portion having a handle at an end opposite from the end with the pin base; a bushing mounted about said tube portion for insertion through the structural part of the boat to provide a bearing between the tube portion and the structural part; said bearing having a lip extending therefrom above the structural part; a spring cup embracing said tube portion above said bushing and said lip and resting upon said lip and containing a spring which is positioned about said tube portion; said spring engaging said pin base; whereby when said handle is pulled in an axial direction with respect to said tube portion, the pin base compresses said spring as the pins in the base are disengaged from said lock.

* * * * *